US006367998B1

(12) United States Patent
Lee

(10) Patent No.: US 6,367,998 B1
(45) Date of Patent: Apr. 9, 2002

(54) PAPER JAMMING PREVENTION DEVICE

(75) Inventor: Yong-Duk Lee, Kyungki-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/003,369

(22) Filed: Jan. 6, 1998

(30) Foreign Application Priority Data

Jan. 6, 1997 (KR) ..... 97-105

(51) Int. Cl.[7] ..... B41J 13/10
(52) U.S. Cl. ..... 400/642; 400/625
(58) Field of Search ..... 400/642, 625, 400/624, 626, 627, 578; 271/188, 213, 214, 177, 306, 120

(56) References Cited

U.S. PATENT DOCUMENTS 4,059,203 A 11/1977 Wright
5,069,435 A 12/1991 Mizutani
5,135,321 A * 8/1992 Olsen et al. ..... 400/605
5,152,622 A * 10/1992 Rasmussen et al. ..... 400/579
5,269,613 A * 12/1993 Olson et al. ..... 400/569
5,299,875 A 4/1994 Hock et al.
5,603,493 A 2/1997 Kelly
5,648,807 A 7/1997 Saito et al.
5,725,319 A * 3/1998 Saito et al. ..... 400/629
5,867,196 A * 2/1999 Kiyohara et al. ..... 347/104
5,888,001 A * 3/1999 Sheng ..... 400/646

* cited by examiner

*Primary Examiner*—John S. Hilten
*Assistant Examiner*—Darius N. Cone
(74) *Attorney, Agent, or Firm*—Robert E. Bushnell, Esq.

(57) ABSTRACT

A paper jamming prevention device includes a conveying portion for conveying a sheet of paper from a paper feeding portion according to a feed command; a discharging portion for receiving the conveyed sheet of paper for discharge; and a base frame, installed between the conveying portion and the discharging portion, having a flat surface disposed toward the conveying portion and a curved conveyance surface disposed toward the discharging portion, the conveyance surface deviating from the flat surface toward the discharging portion. The conveyance surface has a curved middle region and side regions which slope symmetrically upward on each side of the base frame. The discharging portion is made up of discharging rollers and star wheels installed along the curvature of the conveyance surface.

20 Claims, 7 Drawing Sheets

PAPER JAMMING PREVENTION DEVICE

CLAIM OF PRIORITY

This application makes reference to, incorporates the same herein, and claims all benefits accruing under 35 U.S.C. §119 from my application entitled Ink-Jet Printer With Function of Preventing Jamming Caused by Paper Warping filed with the Korean Industrial Property office on Jan. 6, 1997 and there duly assigned Ser. No. 97-00105 by that Office.

BACKGROUND OF THE INVENTION

1. Field of the Invention

The present invention relates to printers and, more particularly, to a device for preventing the jamming of printed sheets of paper that become curled during conveyance.

2. Discussion of Related Art

A typical ink-jet printer is generally includes a paper feeding device for supplying paper in sheets, a conveying device for conveying the supplied paper from the paper feeding device, a printing device for performing a print operation on the conveyed paper, and a discharging device for discharging printed paper. FIG. 1 shows the internal construction of such a printer.

In FIG. 1, sheets of paper 1 are seated on a paper feeding device 10 and individually fed through a conveying device 20 by a plurality of feed rollers 21 and friction rollers 22. A printing device 30 is provided with a pulley 32 driven by a motor 31 via a timing belt 33, which laterally transfers a carriage 34 that carries of print heads 35. Line-by line printing is performed as the heads 35 move left and right across the paper that is gradually conveyed over a base frame 40 toward a discharging device 50. The base frame 40 acts as a support plate for printing in opposition to the reciprocating print heads 35. When the paper bearing formed images arrives at the discharging device 50, it is discharged between a plurality of discharging rollers 52, being rotated by force transmission rollers 51 that are in contact with the feed rollers 21, and a plurality of star wheels 53 (shown in FIG. 2). A cover door 60 is installed on the ink-jet printer.

Accordingly, the paper path consists of the paper feeding device, the conveying and printing device, and the discharging device. It should be appreciated that, in such an ink-jet printer, the leading edge of the paper being carried from the conveying device to the discharging device is not constrained and is thus free to curl or become distorted in shape (flatness). This is especially true of in dry environment conditions.

As shown in FIG. 2, as the curled sheet of paper 1 moves over the base frame 40 without means for constraint, the leading edge thereof cannot be smoothly inserted between the star wheel 53 and discharging roller 52 and thus escapes from the conveyance path, resulting in a paper jam. Though this problem is particularly exacerbating in a dry environment, any similar warping curling of the printing paper, either before or during printing, tends to cause similar paper jamming conditions.

SUMMARY OF THE INVENTION

Therefore, in order to overcome such drawbacks of the prior art, an objective of the present invention is to provide a device which prevents paper jamming, even if the leading edge of a conveyed sheet of paper printed is curled.

It is another objective of the present invention to provide an ink-jet printer whose structure provides for paper jamming prevention means without undue increases in product costs.

To achieve these and other advantages and in accordance with the purpose of the present invention, as embodied and broadly described, there is provided a paper jamming prevention device having: a conveying portion for conveying a sheet of paper from a paper feeding portion according to a feed command; a discharging portion for receiving the conveyed sheet of paper for discharge; and a base frame, installed between the conveying portion and the discharging portion, having a flat surface disposed toward the conveying portion. The conveying portion located toward the discharging portion, is curved and induces the paper to sag.

In the preferred embodiment of the present invention, the base frame over which printed paper is conveyed has a curved conveyance surface, excluding a printing surface of which must be flat, along which discharging means are disposed. As a printed sheet of paper passes through the curved conveyance surface of the base frame, it is inherently contoured such that the cross-section of the paper's middle region is depressed. Therefore, even with an upward warping force, the leading edge of the paper retains its directness of forward orientation and does not curl upward, due to the inherent rigidity maintained by the sagging of the middle region thereof.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols represent the same or similar components, wherein.

DETAILED DESCRIPTION OF PREFERRED EMBODIMENT

Figure 1:
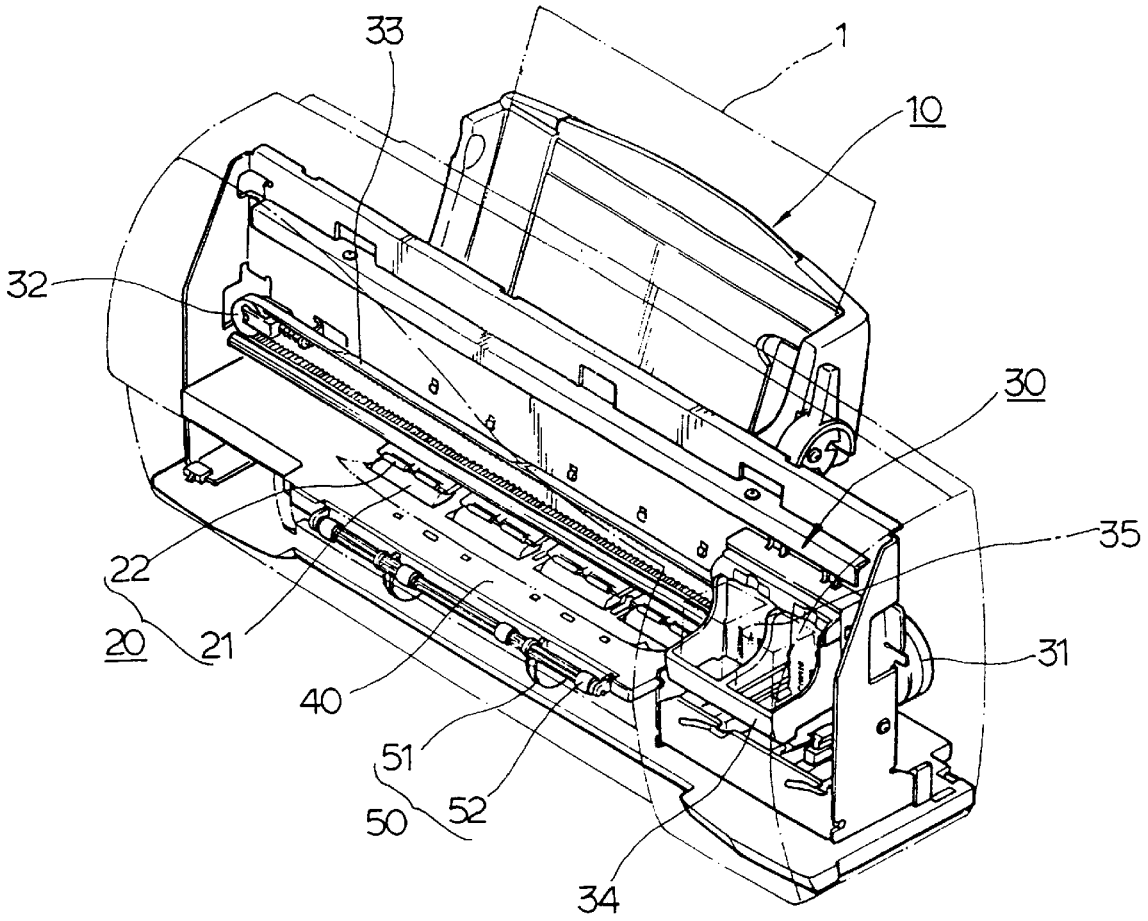
FIG. 1 (PRIOR ART)
FIG. 1 is a perspective view of a typical ink-jet printer.
Figure 2:
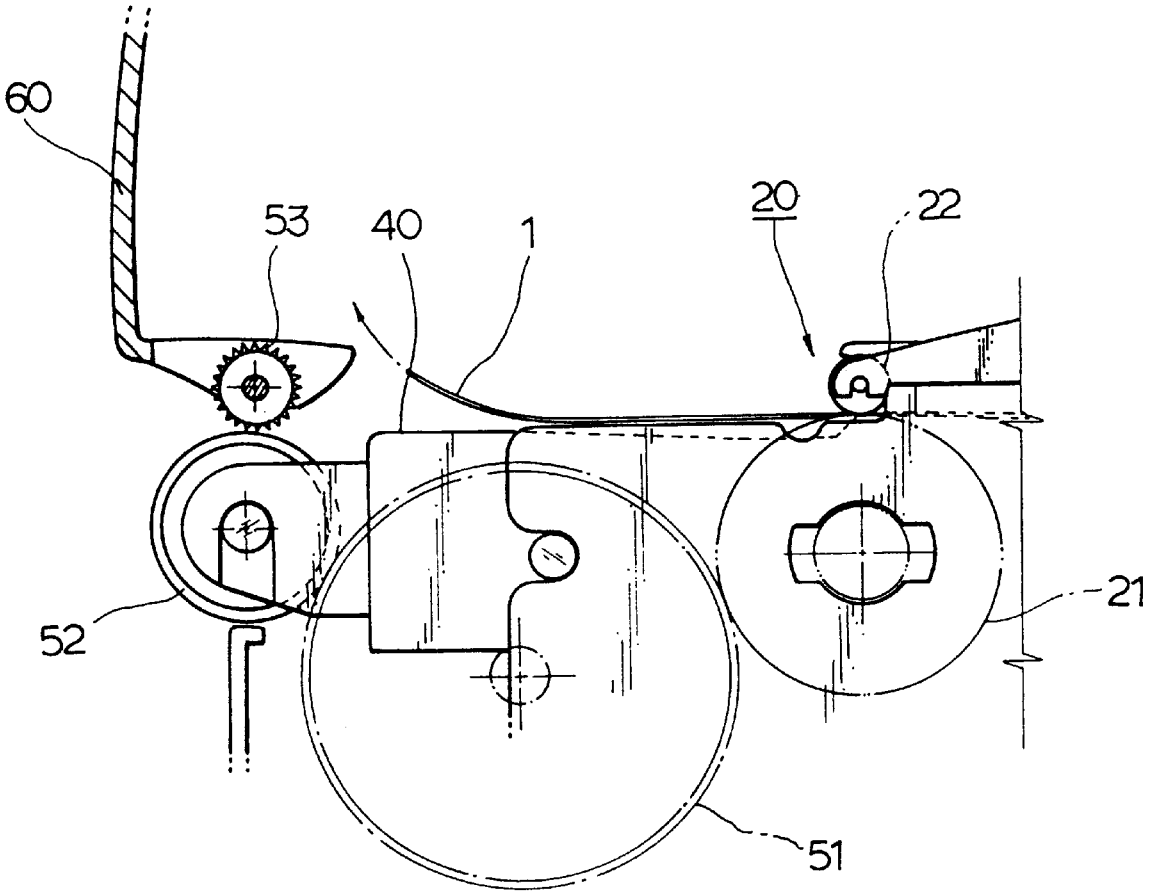
FIG. 2 (PRIOR ART)
FIG. 2 is a side sectional view of the ink-jet printer of FIG. 1, showing a paper jam condition.
Figure 3:
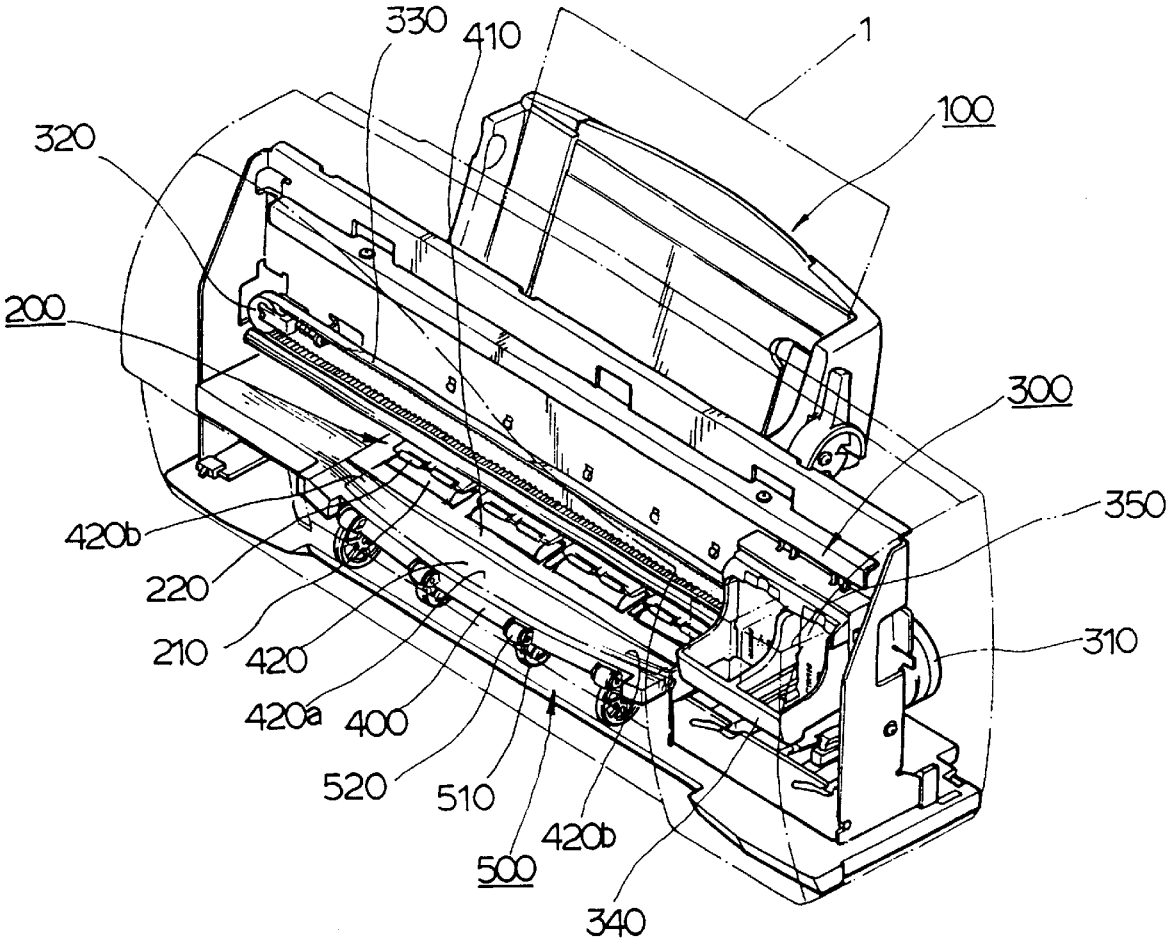
FIG. 3 is a perspective view of an ink-jet printer in which an embodiment of the present invention is implemented.
Figure 4:
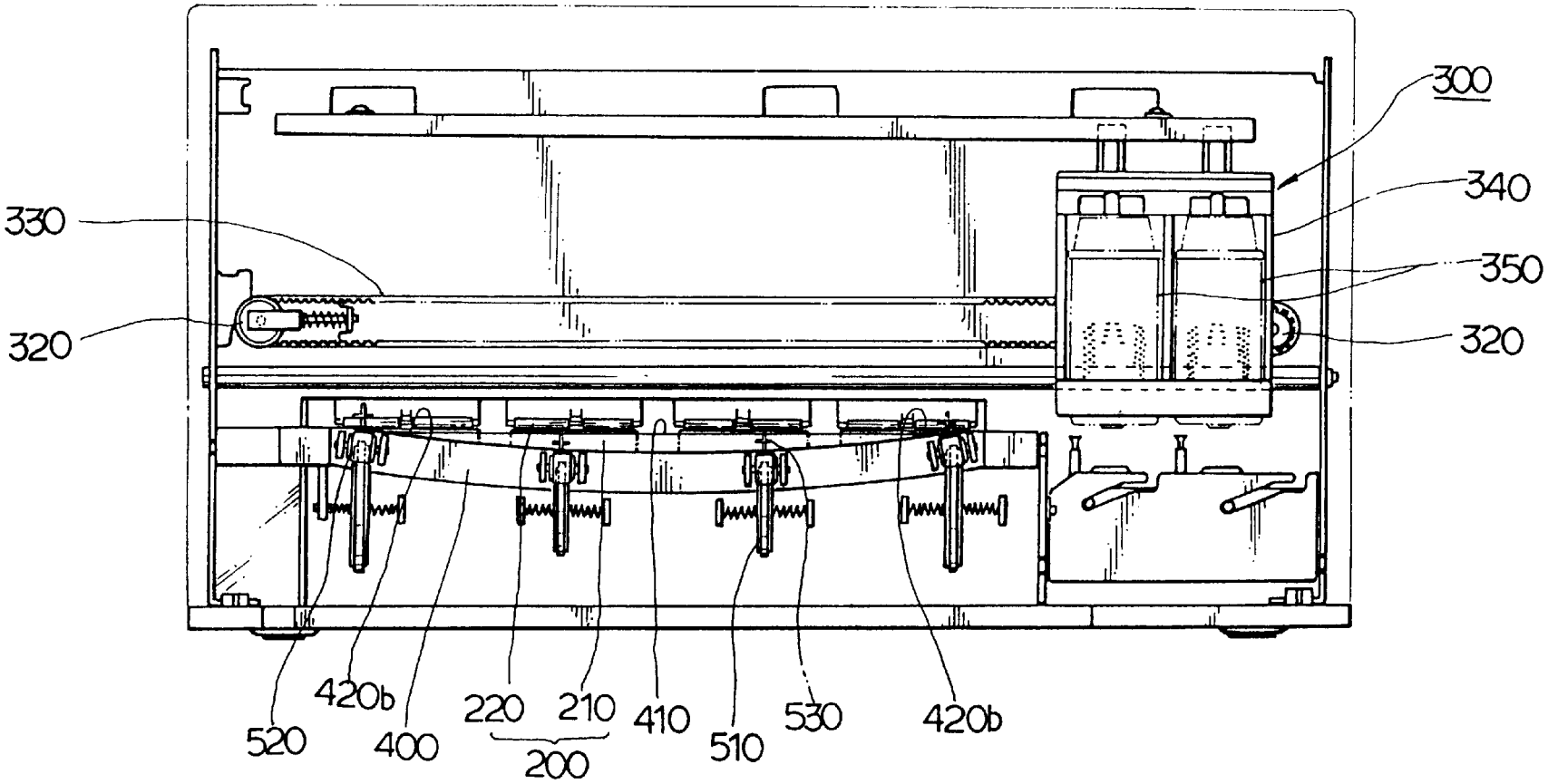
FIG. 4 is a front view of the ink-jet printer in which the embodiment of the present invention is implemented.
Figure 5:
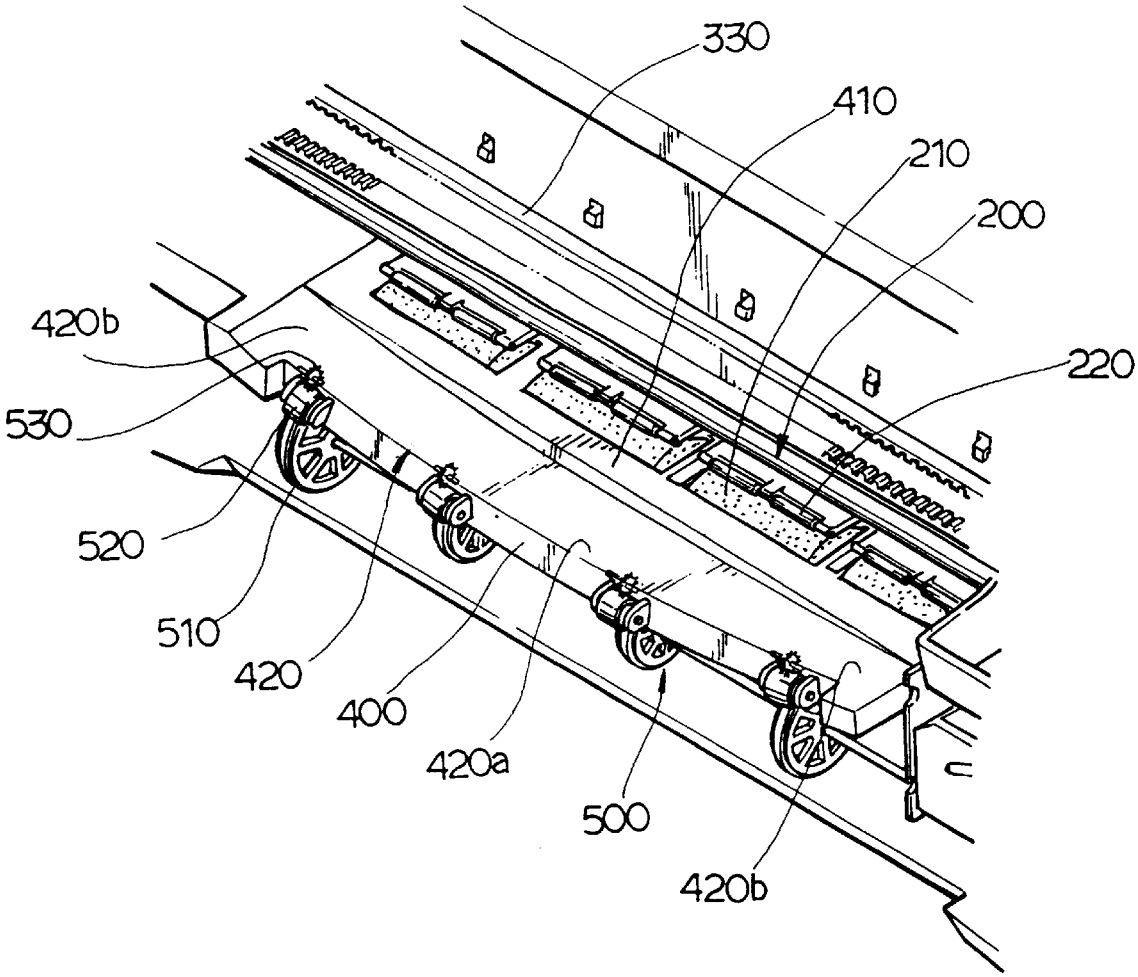
FIG. 5 is an enlarged perspective view of the present invention.
Figure 6:
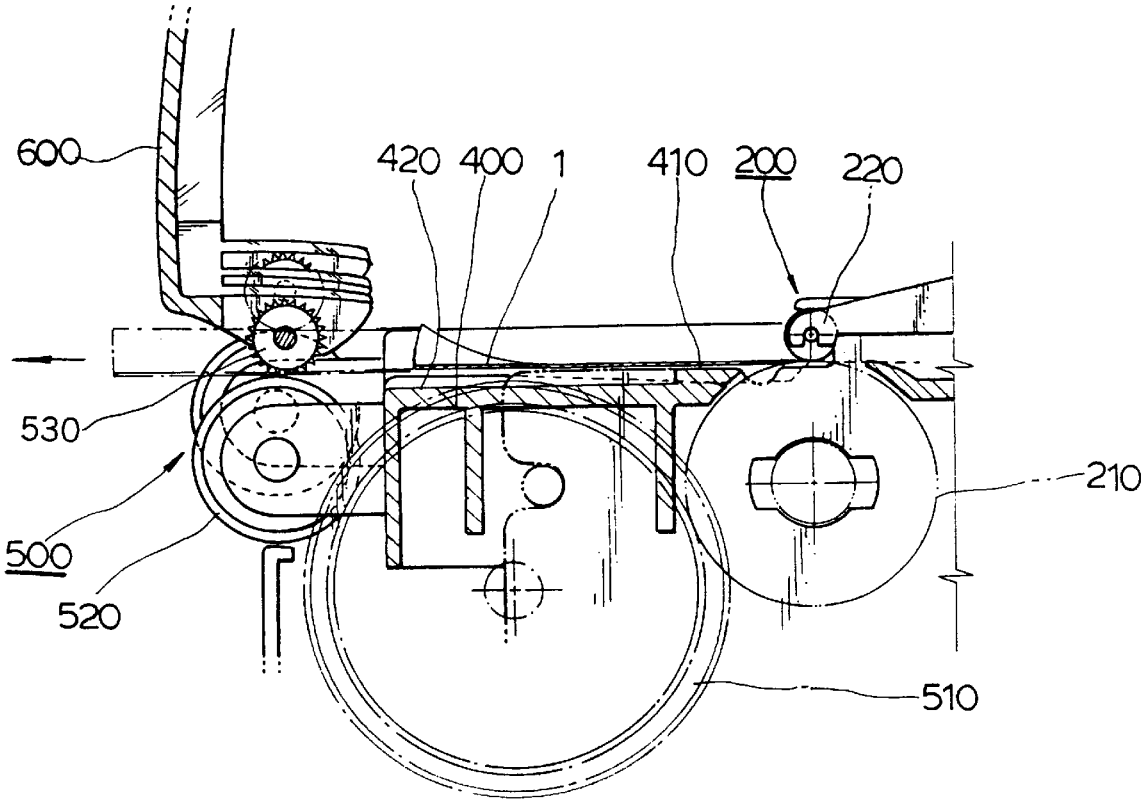
FIG. 6 is a side sectional view showing the operation of the present invention.
Figure 7:
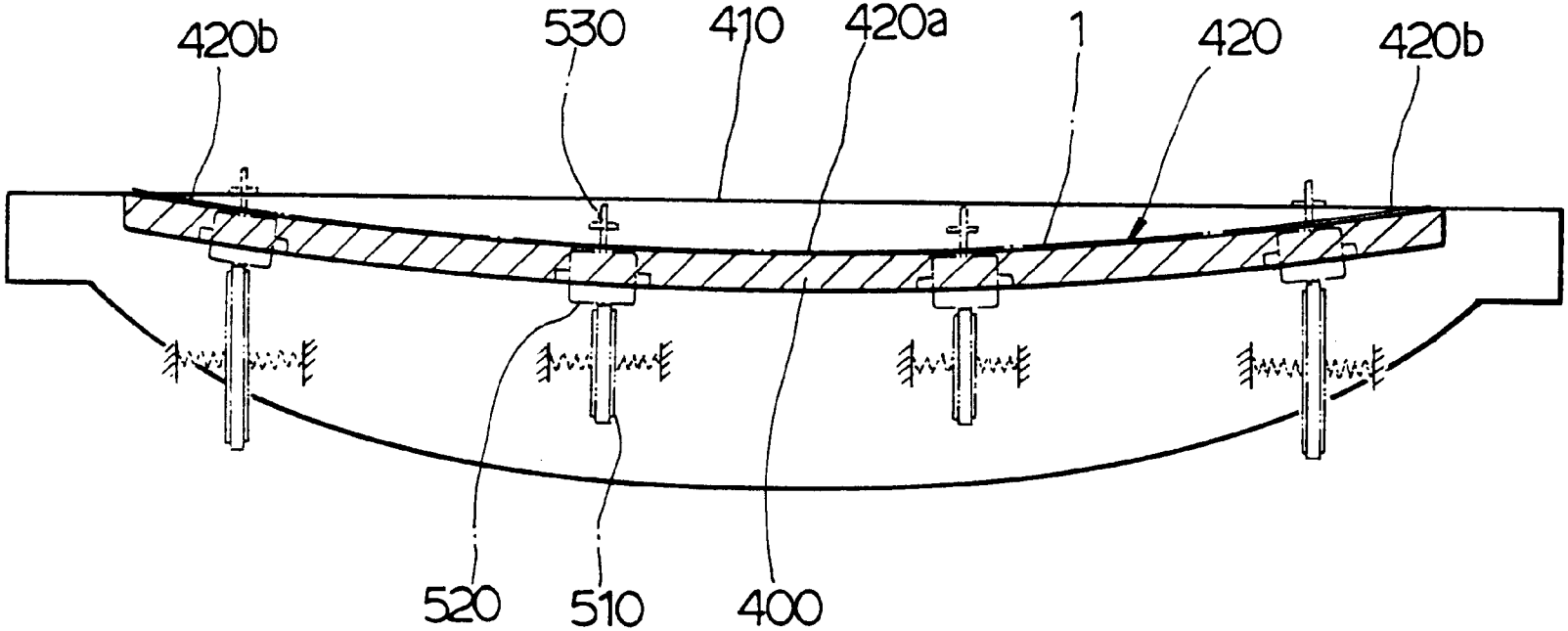
FIG. 7 is a view for illustrating a construction of the present invention.

Referring to FIGS. 3–7, an embodiment of the present invention roughly includes a paper feeding portion 100 for individually supplying sheets of paper 1, a conveying portion 200 for conveying the paper 1 from the paper feeding portion 100 so that line-by-line printing is performed, a printing portion 300 for performing a print operation, and a discharging portion 500 for discharging printed sheets of paper. The conveying portion 200 has a plurality of feed rollers 210 and friction rollers 220, the feed rollers 210 being rotated by the driving force of a main motor (not shown) according to a print feed command and the friction rollers 220 being rotated by the conveyance of the paper 1 on the feed rollers 210. A printing device 300 is provided with a pulley 320 driven by a motor 310 via a timing belt 330, which laterally transfers a carriage 340 that carries a pair of print heads 350. The sheet of paper 1 is thus conveyed onto a flat printing surface 410 of a base frame 400 for printing. As a characteristic feature of the present invention, a curved conveyance surface 420, as a paper sag inducing means, deviates from the flat printing surface 410 toward the discharging portion 500, such that a middle region 420*a* dips lower than side regions 420*b* which slope symmetrically upward on each side of the base frame 400.

Making up the discharging portion 500, are a plurality of discharging rollers 520 and star wheels 530 that are disposed along the contour of the curved conveyance surface 420, the star wheels 530 rotating relatively with respect to the discharging rollers 520 in pairs. The star wheels 530 may be rotatably installed in a cover door 600 or mounted internally. Also, a plurality of force transmission rollers 510 are provided which may be installed axially, such that their diameters differ as shown in the embodiment, or along the same curvature.

In the operation of an ink-jet printer in which the above embodiment of the present invention is implemented, when a sheet of paper 1 is supplied via the conveying portion 200, it is conveyed between the feed rollers 210 and friction rollers 220 and printing is performed upon reaching the printing surface 410 of the base frame 400. As printing advances, the paper travels along the top surface of the base frame 400 and arrives at the curved conveyance surface 420 thereof. At this time, the conveyed sheet is contoured such that its mid section, coinciding with the middle region 420*a* of the curved conveyance surface 420, is lowered naturally (sags) due to the upwardly sloping side regions 420*b* thereof. The paper thus begins to travel with the same form as the curved conveyance surface 420 of the base frame 400.

With this construction, the leading edge of the paper does not curl, even in a dry environment, due to the sagging force of the paper caused by the natural shape of the curved conveyance surface 420 whose sides slope upward from its middle. The conveyed paper whose form is thus controlled enters and exits the discharging portion 500 without jamming, because the discharging rollers 520 and star wheels 530 are disposed in the same arced pattern along the curved conveyance surface 420.

According to the present invention as described above, paper jamming does not occur because the leading edge of the paper does not remain curled upward in a conveyance section as it is conveyed from the printing section of the base frame to the discharging portion, thereby obtaining enhanced product performance and reliability.

It will be apparent to those skilled in the art that various modifications can be made in the paper jamming prevention device of the present invention, without departing from the spirit of the invention. Thus, it is intended that the present invention cover such modifications as well as variations thereof, within the scope of the appended claims and their equivalents.

What is claimed:

1. A paper jamming prevention device of a printer, comprising:

a conveying portion conveying a sheet of paper from a paper feeding portion in response to a feed command;

a discharging portion receiving the conveyed sheet of paper, said discharging portion discharging the sheet of paper from said printer, and a base frame, installed between and supporting said conveying portion and said discharging portion, having a flat surface disposed toward said conveying portion and having a first surface being transversely curved with respect to a direction of conveyance of said sheet of paper and disposed toward said discharging portion, a middle section of the first surface being below a level of the flat surface and side regions of the first surface being at the same level as the flat surface.

2. The device as claimed in claim 1, wherein the first surface of said base frame is a continuous surface having a curved middle region and symmetrically sloping side regions transverse to the direction of conveyance of said sheet of paper located on each side of said base frame.

3. The device as claimed in claim 2, wherein said discharging portion comprises a plurality of discharging rollers and star wheels installed along the curvature of the first surface of said base frame.

4. The device of claim 1, further comprising:

a motor attached to said printer and providing torque to a driving pulley;

said driving pulley having a belt attaching said driving pulley to a carriage body, said carriage body slidably mounted on a shaft and containing a printing cartridge; and said printing cartridge moving in response to said motor controlled by a plurality of circuitry.

5. A device for preventing paper jams in an image forming device, comprising:

a paper tray holding a plurality of cut sheets of a printable medium that are individually fed into said image forming device;

a plurality of first rollers in contact with said printable medium and conveying said printable medium along a paper path from said paper tray;

each one a plurality of second rollers corresponding to each one of said first roller and in contact with said printable medium and providing friction against said printable medium;

a flat portion receiving said printable medium along the paper path from said first and second rollers;

a curved portion being concave in shape and receiving said printable medium from said flat portion, said curved portion having a width not less than a width of said printable medium and having a middle section at a level below a level of said flat portion;

a plurality of third rollers installed along the curvature of said curved portion located on a front side of said curved portion away from said flat portion, said first rollers in contact with a first side of said printable medium and discharging said printable medium from said curved portion and said image forming device with a rotation of said first rollers; and a plurality of fourth rollers installed along the curvature of said curved portion with each one of said fourth rollers corresponding and in contact with each one of said third rollers, said fourth rollers forcing a corresponding movement with said third rollers.

6. The device of claim 5, further comprising:

a motor attached to said image forming device and providing torque to a driving pulley;

said driving pulley having a belt attaching said driving pulley to a carriage body, said carriage body slidably mounted on a shaft and containing a printing cartridge; and said printing cartridge moving in response to said motor controlled by a plurality of circuitry.

7. The device of claim 5, further comprised of a bow in said printable medium consisting of two edges of said printable medium that are parallel to said printable medium's direction of transport being raised symmetrically upward.

8. The device of claim 5, further comprising a plurality of wheels aligned along a curvature of said curved portion with each one said wheels corresponding to each one of said third rollers and receiving said printable medium from said curved portion, said wheels having a plurality of protrusions along a circumference of said wheel and in contact with a second side of said printable medium guiding said printable medium through a plurality of rollers to expel said printable medium from said image forming device.

9. A device for preventing paper jams in an image forming device, comprising:

a paper feeding portion having a paper tray holding a plurality of cut sheets of a printable medium that are individually fed into said image forming device;

a conveying portion having a plurality of first rollers and second rollers, a rotation of the first rollers conveying the printable medium from said paper feeding portion to a printing portion; the second roller providing friction towards the printable medium and the first roller;

said printing portion being a flat surface receiving the printable medium from said conveying portion, said printing portion accommodating an image forming on the printable medium;

a first surface being transversely curved and receiving the printable medium from said printing portion, a middle section of the first surface being below the flat surface of said printing portion and side regions of the first surface being at a same level as the flat surface; and a discharging portion having a plurality of third rollers disposed along a curvature of said first surface at a periphery of said first surface away from said printing portion, said discharging portion discharging the printable medium from said image forming device.

10. A device for preventing paper jams in an image forming device comprising:

a paper feeding portion having a paper tray holding a plurality of cut sheets of a printable medium that are individually fed into said image forming device;

a conveying portion having a plurality of first rollers and second rollers, a rotation of the first rollers conveying the printable medium from said paper feeding portion to a printing portion; the second roller providing friction towards the printable medium and the first roller;

said printing portion being a flat surface receiving the printable medium from said conveying portion, said printing portion accommodating an image forming on the printable medium;

a first surface being transversely curved and receiving the printable medium from said printing portion, a middle section of the first surface being below the flat surface of said printing portion and side regions of the first surface being at a same level as the flat surface;

a discharging portion having a plurality of third rollers disposed along a curvature of said first surface at a periphery of said first surface away from said printing portion discharging the printable medium from said image forming device;

a motor attached to said image forming device and providing torque to a driving pulley, said motor driving the first and third rollers;

said driving pulley having a belt attaching said driving pulley to a carriage body, said carriage body slidably mounted on a shaft and containing a printing cartridge; and said printing cartridge moving in response to said motor controlled by a plurality of circuitry.

11. The device of claim 9, further comprising said discharging portion having a plurality of fourth rollers corresponding and in contact with each one of said third rollers, said fourth rollers forcing a corresponding movement with said third rollers, said fourth rollers leveled along a straight line below said first rollers and said first surface and having varying diameters accommodating contact with said first rollers.

12. The device of claim 11, further comprised of said discharging portion having a plurality of wheels aligned along a curvature of said curved portion and receiving the printable medium from said curved portion, said wheels having a plurality of protrusions along a circumference of said wheel and in contact with a side of the printable medium, each one of the wheels corresponding to each one of the third rollers, said wheels guiding the printable medium through the plurality of third rollers.

13. The device of claim 1, wherein:

the first surface of said base frame being an arc symmetric about the middle section, the width of the first surface being not less than the width of said paper; and said discharging portion comprising:

a plurality of wheels aligned along a curvature of the first surface, said wheels having a plurality of protrusions along the periphery of said wheel and in contact with a first side of said paper;

a plurality of first rollers installed along the curvature of the first surface and corresponding to each one of said wheels and in contact with a second side of said paper, said wheels having a corresponding movement with said first roller; and a plurality of second rollers corresponding and in contact with one of said first rollers, said second rollers forcing a corresponding movement with said first rollers, said second rollers aligned along a straight line below said first rollers and having varying diameters accommodating contact with said first rollers.

14. The device of claim 4, further comprising:

a plurality of first rollers driven by said motor in response to the feed command conveying said paper from the paper feeding portion to said conveying portion;

a plurality of second rollers rotating by said first rollers; and a plurality of third rollers installed along the curvature around a periphery of the first surface facing away from said printer, said third rollers having a corresponding movement with said first rollers, said third rollers discharging said paper out of said printer.

15. The device of claim 5, wherein said curved portion having symmetrically sloping side regions located on each side of said curved portion and said curved portion coupled with said flat portion.

16. A method, comprising the steps of:

forming a paper tray holding a plurality of printable mediums;

attaching a first roller in contact with the printable medium and conveying the printable medium along a paper path from said paper tray;

guiding said printable medium with a second roller corresponding to said first roller;

forming a flat portion receiving said printable medium along a paper path from said first and second rollers;

coupling a curved portion with said flat portion, said curved portion being concave in shape and receiving said printable medium from said flat portion, said curved portion having a middle section below a level of said flat portion;

forcing the printable medium to have a concave shape corresponding to said curved portion when being received by said curved portion; and installing a plurality of third rollers along a curvature of said curved portion and, said third rollers in contact with a first side of the printable medium and discharging the printable medium from said curved portion and said image forming device with a rotation of said third rollers.

17. The method of claim 16, further comprising the steps of:

attaching a plurality of wheels along the curvature of said curved portion and receiving the printable medium from said curved portion, said wheels having a plurality of protrusions along a circumference of said wheel and in contact with a first side of the printable medium, said wheels having a corresponding movement with said third rollers; and attaching a plurality of fourth rollers corresponding and in contact with each one of said third rollers, said fourth rollers forcing a corresponding movement with said third rollers, said fourth rollers installed along the curvature of said curved portion.

18. The method of claim 17, further comprising the steps of:

attaching a motor to said image forming device and proving torque to a driving pulley;

driving said first and fourth rollers with said motor;

attaching said driving pulley to a carriage body and attaching a belt to said driving pulley, said carriage body slidably mounted on a shaft and containing a printed cartridge; and moving said printed cartridge in response to said motor controlled by a plurality of circuitry.

19. The method of claim 18, wherein both side edges of said curved portion being at a same level as said flat portion.

20. The method of claim 19, wherein said curved portion having symmetrically sloping side regions located on each side of said curved portion, the middle section of said curved portion corresponding to a middle section of the printable medium and the side regions of said curved portion corresponding to side regions of the printable medium.

* * * * *